United States Patent [19]

Baggs

[11] Patent Number: 4,989,491

[45] Date of Patent: Feb. 5, 1991

[54] STRINGED INSTRUMENT WITH RESONATOR ROD ASSEMBLY

[76] Inventor: Lloyd R. Baggs, 1049 Saratoga Ave., Grover City, Calif. 93433

[21] Appl. No.: 297,136

[22] Filed: Jan. 12, 1989

[51] Int. Cl.[5] ..... G10H 3/18

[52] U.S. Cl. ..... 84/723; 84/726; 84/743

[58] Field of Search ..... 84/723–746, 84/DIG. 24, 274–283, 294–296

[56] References Cited

U.S. PATENT DOCUMENTS

| | | | |
|---|---|---|---|
| 646,539 | 4/1900 | Hunt . | |
| 653,521 | 7/1900 | Montoya . | |
| 685,920 | 11/1901 | Heck | 84/294 |
| 722,561 | 3/1903 | Bunch . | |
| 881,769 | 3/1908 | Brown . | |
| 1,539,961 | 6/1925 | Scott | 84/294 X |
| 1,700,395 | 1/1929 | Yuki | 84/294 X |
| 1,778,304 | 10/1930 | Zauner . | |
| 3,595,981 | 7/1971 | Hopping | 84/726 |
| 3,690,210 | 9/1972 | Imal et al. | 84/267 |
| 4,056,034 | 11/1977 | Kaman | 84/267 |
| 4,218,951 | 8/1980 | Carriveau . | |
| 4,314,495 | 2/1982 | Baggs | 84/731 |
| 4,635,523 | 1/1987 | Merchant | 84/307 |
| 4,727,634 | 3/1988 | Fishman | 84/DIG. 24 |
| 4,741,238 | 5/1988 | Carriveau | 84/291 |
| 4,750,397 | 6/1988 | Ashworth-Jones | 84/DIG. 24 |
| 4,774,867 | 10/1988 | Fishman | 84/DIG. 24 |
| 4,785,704 | 11/1988 | Fishman | 84/DIG. 24 |
| 4,843,937 | 7/1989 | Murphy | 84/DIG. 24 |
| 4,867,027 | 9/1989 | Barbera | 84/DIG. 24 |

*Primary Examiner*—Stanley J. Witkowski
*Attorney, Agent, or Firm*—Christie, Parker & Hale

[57] ABSTRACT

A stringed instrument is provided which incorporates a resonator assembly mounted within its body which enhances the quality of the sound produced by the instrument. The resonator assembly includes either one or more resonator rods or one or more resonator springs tuned to desired frequencies, which are generally below about 200 cycles per second.

68 Claims, 7 Drawing Sheets

STRINGED INSTRUMENT WITH RESONATOR ROD ASSEMBLY

FIELD OF THE INVENTION

The present invention relates to musical instruments which incorporate strings that are struck or plucked to provide the instrument's sound. More particularly, each stringed instrument provided in accordance with this invention includes a resonator assembly mounted within its body and configured to enhance the quality of the sound produced by the instrument.

BACKGROUND OF THE INVENTION

Various musical instruments, such as guitars, incorporate strings that are struck or plucked to produce their sound. The sound quality of such instruments varies depending upon their construction and design. It is desirable, of course, to provide an instrument with the best possible sound quality.

One type of stringed instrument, for example, a "full-body" acoustic guitar, includes a hollow body which incorporates a sound board and an elongated neck which is attached to the body and extends away from it. The term "full-body" acoustic guitar when used herein means the relatively large-body standard acoustic guitar. The neck carries a finger board and includes a tensioning device at its free end to which one end of each of the strings is attached and which is used for adjusting the tension of the strings. A bridge assembly, which is mounted on the external surface of the sound board, includes a saddle over which the strings are trained and mounting brackets for attachment of the opposite ends of the strings.

The sound of a guitar is generated by the vibration of the strings. String vibration, in turn, is influenced by the vibration of the sound board, other components of the instrument body, and the air within the body (when the body is hollow).

The sound developed by a guitar can be amplified by means of a sound system. Such a sound system includes a transducer, such as a piezoelectric or magnetic device incorporated into the instrument, which converts mechanical energy generated by string vibration into an electrical signal. The electrical signal is transmitted to an audio system, where it is amplified and subsequently transmitted through speaker systems to be heard.

The full-body acoustic guitar has many resonances, the sum of which determines its voice or sound. Because of the full-body acoustic guitar's relatively large and flexible sound board, and the relatively large air cavity within its body, a full-body acoustic guitar has several strong, low frequency resonances. These low frequency resonances are particularly responsible for its excellent sound quality. As opposed to the full-body acoustic guitar, the modern amplified (electric) guitar has a different shape and is smaller than the acoustic guitar. The size and shape of the electric guitar are dictated, in part, by the desire to provide an instrument that is easier to handle than the acoustic guitar and to accommodate the design preference of musicians in response to audience appeal. Although some electric guitars have a hollow body and associated sound board, others have a "solid body" which includes one or more relatively small cavities formed therein of a size only large enough to house various electronic or mechanical components, and the like. Electric guitars do not generate the same low frequency resonances as the full-body acoustic guitar and, thus, do not provide the same desired sound quality as is provided by the acoustic guitar.

There is a need in the art for an electric guitar that provides a sound quality approaching that of a acoustic guitar and also for acoustic guitars with improved sound quality.

SUMMARY OF THE INVENTION

The present invention is directed to instruments comprising strings that are struck or plucked to produce a musical sound. Such instruments generally comprise a body and an elongated neck attached at one end to the body and extending away from it. The end of the neck remote from the body, the distal end, is adapted to attach the distal ends of a plurality of strings. The instruments of this invention include those which have hollow bodies, such as acoustic guitars and some electric guitars, and those which have solid bodies, such as standard electric guitars.

One embodiment of a hollow-body stringed instrument provided in accordance with practice of this invention comprises a sound board, a bridge assembly, and a resonator assembly. The sound board has an interior surface and an exterior surface, with the bridge assembly mounted on its exterior surface. The bridge assembly includes a bridge plate on which a saddle assembly is mounted and onto which the proximal ends of the strings are attached. Thus, the strings extend from their distal end attachments on the neck, over the top surface of the saddle assembly, to their proximal end attachments on the bridge plate.

A preferred embodiment of a resonator assembly provided in accordance with this invention for incorporation into a hollow-body instrument comprises a resonator rod support mounted on the interior surface of the sound board with at least one resonator rod mounted on the support. The longitudinal axis of each such resonator rod extends generally about parallel to the longitudinal axis of the instrument.

A preferred embodiment of a resonator assembly provided in accordance with this invention for incorporation into solid-body instruments, as well as into hollow-body instruments, comprises resonator springs. The resonator spring assembly includes a pair of resonator supports mounted on the interior surface of the sound board and spaced apart from each other along the longitudinal axis of the instrument. At least two resonator springs are attached between the resonator supports, with the springs extending generally about parallel to the longitudinal axis of the instrument and tuned to provide a consonance. When more than two springs are provided, the springs are tuned to a chord.

In another preferred embodiment of the present invention, a resonator rod assembly kit is provided for installation into a hollow-body instrument. The resonator rod assembly kit includes a support pedestal configured to be attached to the inside surface of the sound board, with at least one rod mounted on the pedestal. The rod has a free end remote from the pedestal and is configured to extend generally parallel to the surface of the sound board. In a first embodiment, a transducer is mounted in the rod to pick up the vibration of the rod, and means are provided for transmitting the picked-up vibration to an audio system. In a second embodiment, the rods do not include a transducer, but, instead, the kit includes a vibration pick-up device configured for mounting on the instrument in proximity to each of the resonator rods.

In yet another preferred embodiment of the present invention, a resonator spring assembly kit is provided for installation into either a hollow-body or a solid-body instrument. The resonator spring assembly kit includes at least two resonator springs and a resonator spring support to which the ends of the springs can be attached. Means are provided for tuning the resonator springs to a frequency below about 200 cycles per second.

BRIEF DESCRIPTION OF THE DRAWINGS

These and other features, aspects, and advantages of the present invention will be more fully understood when considered with respect to the following detailed description, appended claims, and accompanying drawings, wherein:

FIG. 1O is a semi-schematic perspective view of one embodiment of a resonator spring assembly kit provided in accordance with practice of this invention for installation into a cavity formed in the body of a solid-body electric guitar.

DETAILED DESCRIPTION

Figure 1:
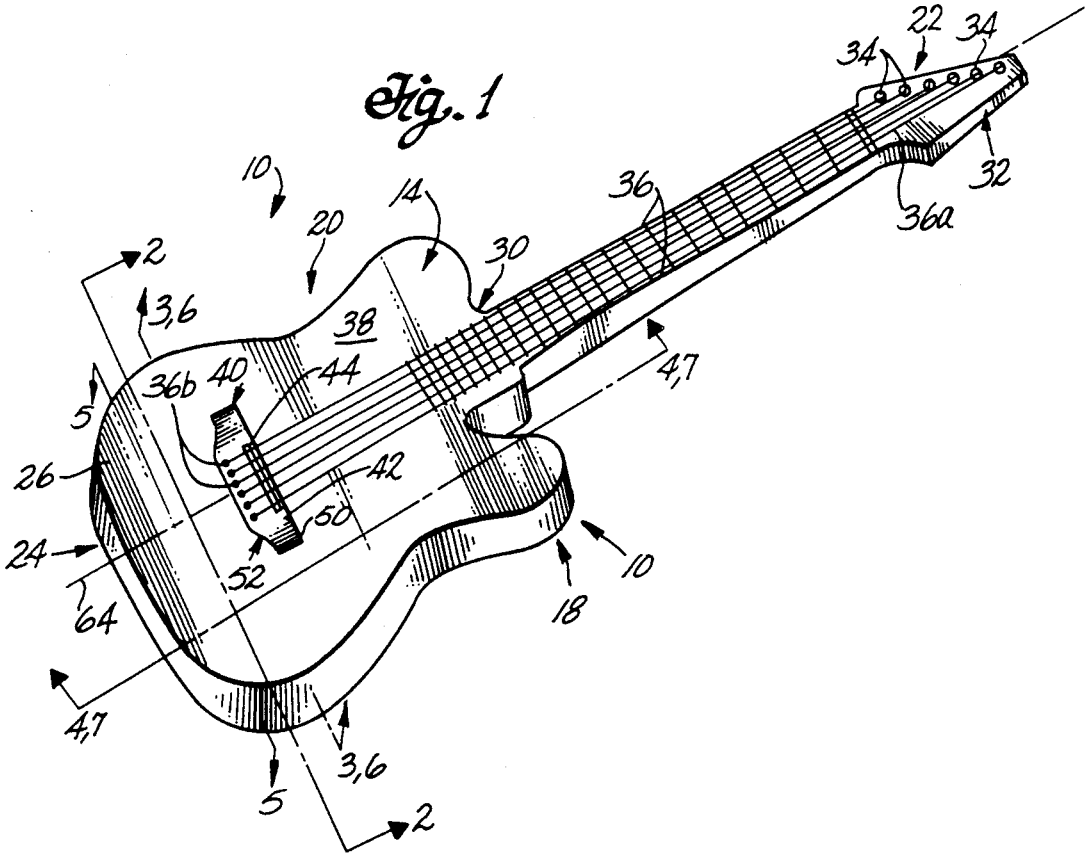
FIG. 1 is a semi-schematic perspective view of a preferred embodiment of a hollow-body electric guitar incorporating a resonator assembly (not shown) provided in accordance with the present invention mounted inside the body on the interior surface of the guitar sound board.
Figure 2:
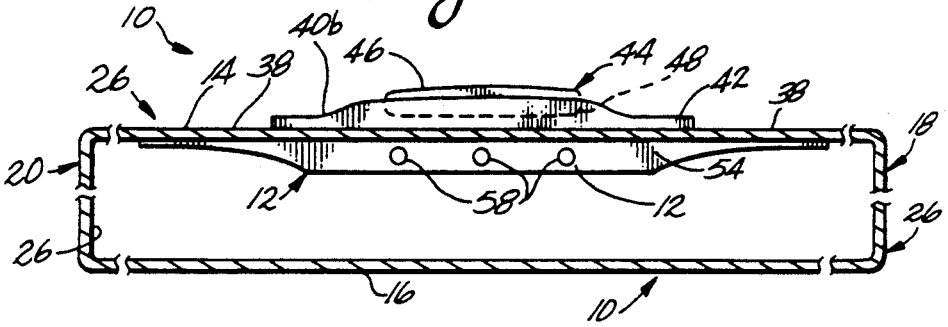
FIG. 2 is a semi-schematic cross-sectional view taken on line 2—2 of FIG. 1 showing a preferred embodiment of the resonator assembly on the sound board.

Turning to the figures, wherein like structural components are identified by like reference numerals, and referring particularly to FIGS. 1-4, there are shown various views of a hollow-body electric guitar 10 incorporating a preferred embodiment of a resonator assembly 12 provided in accordance with practice of principles of the present invention. So that the position of the components of the guitar 10 relative to each other can be readily understood, the guitar is described with reference to its front side 14, its back side 16, its right side 18, its left side 20, its top end 22, and its bottom end 24.

The guitar 10 includes a hollow body 26 and an elongated neck 28 attached at its bottom end 30 to the body 26 and extending away therefrom. The end of the neck 28 remote from the guitar body 26, i.e., its top end, incorporates a standard tuning device 32, which includes six tuning posts 34 for attachment of one end of each of six standard guitar strings 36 (the strings are not shown in FIG. 2). Although six strings are incorporated in the guitar of the illustrated embodiment, stringed instruments having more or fewer than six strings are contemplated.

The front 14 of the guitar body 26 includes a sound board 38, preferably made of wood, with a bridge assembly 40 mounted on its exterior surface. Braces 41 (shown in FIG. 3), made of strips of wood, can be provided, if desired, attached by adhesive means, or the like, to the interior surface of the sound board. The braces reinforce the sound board and can have configurations other than the configuration shown in FIG. 3. The bridge assembly 40 of the illustrated embodiment includes a bridge plate 42, preferably made of wood, and a saddle assembly 44 mounted on the bridge plate. The strings 36 extend from their distal ends **36*a*, which are remote from the guitar body and which are attached to the tuning posts 34, along the guitar neck 28, across the saddle assembly 44, to their opposite or proximal ends 36*b*, which are attached to the bridge plate 42**.

In a preferred embodiment of the present invention, the saddle assembly 44 comprises an elongated saddle 46 mounted in an elongated slot 48 (shown in dashed lines in FIG. 2) formed in the bridge plate 42. Thus, the saddle assembly is positioned between the center of the bridge plate and the edge 50 of the bridge plate nearest the top of the guitar, i.e., the distal edge of the bridge. The proximal ends of the strings, conversely, are attached between the center the bridge plate 42 and the edge 52 of the bridge nearest the bottom 24 of the guitar, i.e., the proximal edge of the bridge. The saddle 46 includes a transducer (not shown) which is formed integrally with the saddle and extends along its length. In the illustrated embodiment, the longitudinal axis of the saddle is at a slight angle with the strings while extending across and under the strings. The transducer is provided to pick up string vibration and includes means (not shown) for transmitting the picked-up signal to an audio system. In one embodiment of the present invention, the saddle assembly and transducer are of the type, and are fabricated of material, such as that disclosed in U.S. Pat. No. 4,314,495, which issued to me on Feb. 9, 1982, and which is incorporated herein by this reference. Although piezoelectric transducers are preferred, other types of transducers, such as magnetic transducers, can be used, if desired. In embodiments of the present invention which include resonator assemblies incorporated into hollow-body, non-electric stringed instruments, such as, for example, full-body acoustic guitars, the saddle assembly 44 does not include a transducer.

The resonator assembly 12 includes an elongated resonator rod support 54 mounted on the interior surface 56 of the sound board 38. At least one resonator rod 58 is mounted on one end 60 in the rod support 54, with its free end 62 extending away from the support. In a preferred embodiment, the ends 60 are mounted by means of an adhesive into holes (not shown) in the support 54. The longitudinal axis of the rod support 54 extends generally transverse to the direction of the strings beneath and across the strings. Preferably, the rods 58 extend in a generally parallel relationship to the sound board, with the longitudinal axis of the rods preferably extending generally about parallel to the longitudinal axis 64 of the instrument. Although the resonator rods 58 of the exemplary embodiment are circular in cross-section, resonator "rods" having other cross-sections, such as triangular or rectangular, can also be used, if desired.

Resonator rods provided in accordance with this invention can be made of various materials, such as plastic, metal, wood, or the like. In a preferred embodiment, the rods are polystyrene plastic. The resonant frequency of such a resonator rod depends on the physical characteristics of the material from which it is made, its mass, and its length. It has been found that the sound quality of a stringed instrument of the present invention is optimized when at least a portion of the resonator rods is tuned to frequencies below the resonant frequency of the sound board. For example, it has been shown that the mechanical impedance of a sound board increases logarithmically below its resonant frequency. Thus, the ability of a sound board to amplify sounds that have a frequency below its resonant frequency decreases more and more rapidly as the frequency is lowered. The resonant frequency of the sound board of a full-body acoustic guitar (usually around 100 cycles per second) is close enough to the frequency of the lowest note played (normally about 82.5 cycles per second) so that all notes are amplified approximately evenly. However, the resonant frequency of the sound board of a hollow-body electric guitar (normally 140 to 200 cycles per second) is higher than the resonant frequency of the sound board of a full-body acoustic guitar and is higher than the lowest note which can be played on an electric guitar. Thus, the lowest notes played on such an electric guitar are lower than the resonant frequency of the sound board and are therefore attenuated to a greater degree than desired. This results in a sound that lacks warmth and body. By the addition of resonator rods provided in accordance with this invention tuned below the resonant frequency of the hollow-body electric guitar sound board, notes whose frequencies are lower than the sound board resonant frequency are not as severely attenuated as they are when such tuned rods are not present.

The resonator rods of this invention vibrate in response to the vibration of the strings, and such rod vibration interacts with the vibrations of all of the other components of the instrument, including the string vibration, the vibration of the instrument body, and the vibration of the air within the body. Thus, the resonator rod vibration acts in harmony with the instrument to produce an improved sound quality. It has been found that the interaction of the rods to provide optimum sound quality is achieved when the rods are about parallel to the longitudinal axis 64 of the instrument, i.e., about parallel to the strings. As the rods are moved further and further from this parallel alignment, they become less and less effective in enhancing the quality of sound from the instrument. Rods that extend transverse to the instrument's longitudinal axis are ineffective in enhancing sound quality. It is also preferred that the rods all extend in the same direction from the rod support, preferably toward the bottom of the instrument. Thus, the rods are preferably mounted on one end in the rod support with only one end extending from the support. When rods extend in different directions from the rod support, they tend to interfere with each other, thereby diminishing the sound quality enhancement.

Figure 3:
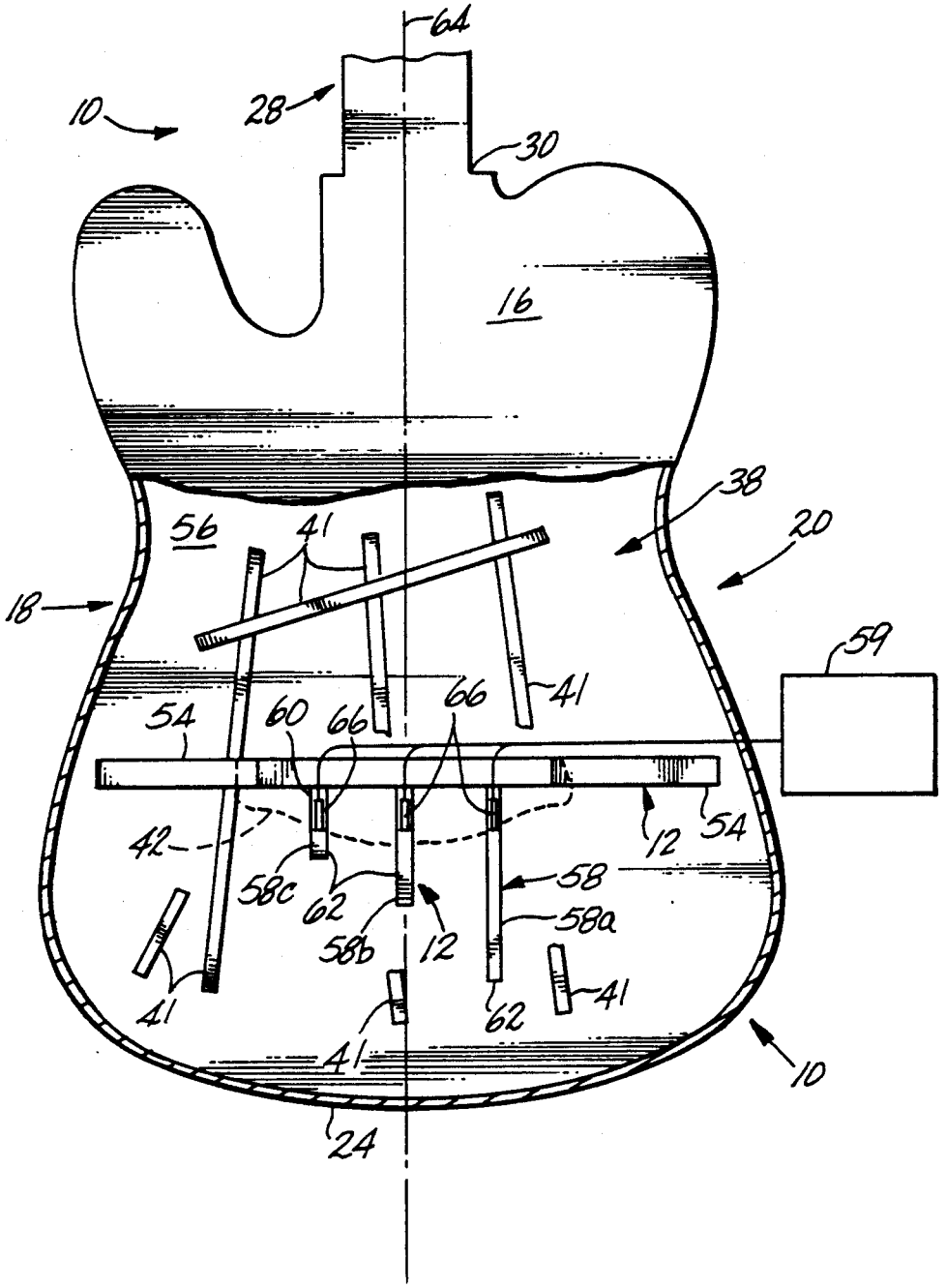
FIG. 3 is a semi-schematic cross-sectional view taken on line 3—3 of FIG. 1 showing the resonator assembly of FIG. 2.
Figure 4:
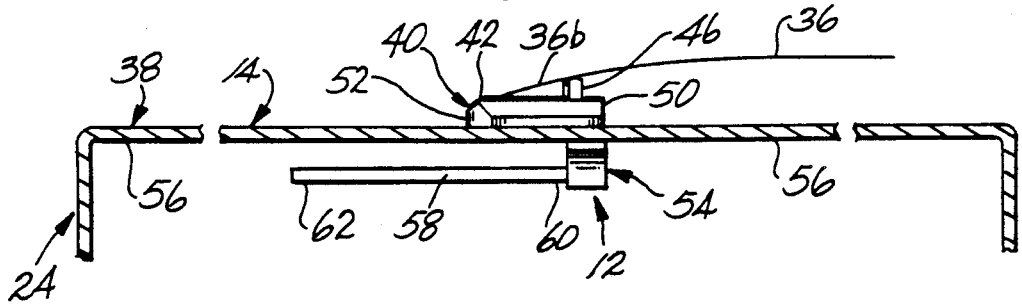
FIG. 4 is a semi-schematic, fragmentary cross-sectional view taken on line 4—4 of FIG. 1 showing the resonator assembly of FIG. 2.

In the illustrated embodiment, three resonator rods 58 are mounted on the rod support 54, each with a different length; a relatively longer resonator rod **58*a*, and intermediate length resonator rod 58*b*, and a relatively shorter resonator rod 58*c* (the length of the rods is shown in FIG. 3**).

When three or more resonator rods 58 are used, as shown in the illustrated embodiment of FIGS. 1–4, in one preferred embodiment, at least a portion of the rods is either tuned to provide a chord, is tuned to provide a consonance, or is tuned to a single frequency. (As is described below in greater detail, if desired, one or more of the rods may also be tuned to the air resonance frequency of the instrument.) A chord is defined as two or more notes, each of which forms a concordant interval with the others. When the rods are not tuned to the same frequency, to a consonance, or to a chord, they are relatively less effective in enhancing the sound quality of the instrument. Examples of chords that incorporate three notes are a major third followed by a minor third, a fourth followed by a major third, a minor third followed by a major third, a minor third followed by a fourth, a major third followed by a fourth, and a fourth followed by a minor third. A perfect consonance is defined as an octave, a fifth, or a fourth, and an imperfect consonance is defined as a major third, a minor third, a major sixth, or a minor sixth.

Definitions of a "chord" and a "consonance" can be found in H.E. White, "The Science of Musical Scale," *Modern College Physics*, Fourth Edition, 1964, Chapter 35, which is incorporated herein by this reference The rods **58*a*, 58*b*, and 58*c* of the illustrated embodiment are tuned to frequencies of 66** cycles per second (note $G_2$), 82.5 cycles per second (note $E_2$), and 99 cycles per second (note $C_2$), respectively. In embodiments of the present invention that comprise resonator assemblies incorporating two resonator rods, it is preferred that the rods are tuned to the same frequency or to two different frequencies to provide a consonance. When a resonator rod assembly is provided that includes only one rod, or a plurality of rods tuned to the same frequency, such a rod or rods are preferably tuned to the resonant frequency of the air within a typical full-body acoustic guitar, i.e., to about 130 cycles per second.

In yet another preferred embodiment, where three or more resonator rods 58 are used, a first portion or group of the rods is tuned either to the same frequency, to a consonance, or to a chord to enhance the sound of the guitar by adding resonances that the host instrument does not have on its own. As is described above, preferably, this first portion of rods is tuned to frequencies below the resonant frequency of the guitar's sound board. In some guitars, however, e.g., hollow-body electric guitars which are smaller than full-body acoustic guitars, there is a strong resonance emanating from the sound board, which has a higher frequency than that of the sound board of a full-body acoustic guitar, and which can leave an undesirable imprint on the "voice" or sound from the instrument. Even though the first portion of rods adds desirable resonances to the hollow-body electric guitar, the resonance of the relatively small sound board of the electric guitar can interfere with and degrade the sound quality of the instrument. In this embodiment, therefore, one or more of the rods, i.e., a second portion of the rods, is tuned to the major natural resonance of the sound board of the hollow-body electric guitar. In this embodiment, one transducer (not shown) is provided to pick up the signal from the first portion of the rods, and a second transducer (not shown) is provided to pick up the signal from the second portion of the rods. Means (shown schematically adjacent the guitar designated by the reference numeral 59), which include components well known to those skilled in the art, are provided to add the signal from the second portion of the rods 180° out of phase to the signal from the first portion of the rods. In this instance, the signal from the second portion of rods cancels the unwanted signal from the sound board resonance, so that only the pleasing resonances remain. This enhances the sound quality of the instrument.

The following non-limiting examples are of preferred embodiments of stringed instruments provided in accordance with this invention comprising resonator assemblies incorporating more than three resonator rods, with the rods tuned to a chord.

EXAMPLE 1

A resonator rod assembly is provided comprising four rods with two rods tuned to 66 cycles per second, one rod tuned to 82.5 cycles per second, and one rod tuned to 99 cycles per second.

EXAMPLE 2

A resonator rod assembly is provided comprising four rods with one rod tuned to 66 cycles per second, one rod tuned to 82.5 cycles per second, one rod tuned to 99 cycles per second, and one rod tuned to 132 cycles per second. In this example, the rod tuned to 132 cycles per second is tuned to a typical air resonance frequency of a full-body acoustic guitar. This enhances the sound from the instrument where the resonant frequency of the sound board is below 132 cycles per second.

EXAMPLE 3

A resonator rod assembly is provided comprising five rods, with two rods tuned to 66 cycles per second, one rod tuned to 82.5 cycles per second, one rod tuned to 99 cycles per second, and one rod tuned to 132 cycles per second.

EXAMPLE 4

A resonator rod assembly is provided comprising five rods, with one rod tuned to 66 cycles per second, two rods tuned to 82.5 cycles per second, one rod tuned to 99 cycles per second, and one rod tuned to 132 cycles per second.

EXAMPLE 5

A resonator rod assembly is provided comprising six rods, with two rods tuned to 66 cycles per second, two rods tuned to 82.5 cycles per second, one rod tuned to 99 cycles per second, and one rod tuned to 132 cycles per second.

EXAMPLE 6

A resonator rod assembly is provided comprising six rods, with one rod tuned to 66 cycles per second, two rods tuned to 82.5 cycles per second, two rods tuned to 99 cycles per second, and one rod tuned to 132 cycles per second.

EXAMPLE 7

A resonator rod assembly is provided comprising eight rods, with the first three rods on the right tuned to 66 cycles per second, the next four adjacent rods tuned to 82 cycles per second, and the last rod tuned to 99 cycles per second. The rods are all made of 0.125 inch diameter clear polystyrene plastic and are of the following lengths, including the 0.38 inch length that is within the resonator rod support: the 99-cycles-per-second rods are 3.30 inches long; the 82-cycles-per-second rods are 3.88 inches long; and the 66-cycles-per-second rods are 4.645 inches long.

It has been found that, in addition to the preferred frequencies to which the rods 58 of resonator assemblies 12 provided in accordance with the present invention are tuned, placement of the resonator rod support 54 influences the quality of the sound produced by the instrument. For example, it is preferred that the rod support 54 is positioned on the inside surface of the sound board nearly beneath the bridge. The phrase "nearly beneath," as used herein, means no more than about two inches toward the top of the guitar from the edge 50 of the bridge nearest the top 22 of the guitar, no more than about three inches toward the bottom 24 of the guitar from the edge 50 of the bridge, and no more than about two inches away from the side edges of the bridge. Preferably, the resonator rod support 54 extends under at least a portion of the bridge assembly 40. More preferably, the rod support 54 is at least as long as the saddle assembly 44 and extends generally along the length of the saddle, under it. When the resonator rod support 54 has the preferred construction and location, the effect of the resonator rods 58 is optimized, thereby enhancing the sound from the instrument to the highest degree possible.

The position of the rods in the resonator support relative to each other, based on the frequencies to which they are tuned, is also important. For example, it is preferred that the frequency to which the rods on the right-hand side of the support, i.e., the treble side, are tuned is relatively higher, with the frequency becoming relatively lower progressing toward the left-hand side of the support, i.e., the bass side.

In an embodiment of a hollow-body electric guitar constructed in accordance with practice of the present invention, a resonator support mounted on the inside surface of the sound board incorporated eight resonator rods constructed of wood and having a rectangular cross-section. The rods were mounted on a rod support that extended under the bridge assembly approximately beneath the elongated saddle, with its longitudinal axis transverse to the strings. The rods were tuned as follows: starting from the right side of the guitar to its left, two rods tuned to 132 cycles per second; two rods tuned to 99 cycles per second; two rods tuned to 82 cycles per second; and two rods tuned to 66 cycles per second.

When the guitars incorporating resonator rod assemblies 12 of the present invention are solid- or hollow-body electric guitars, the signal picked up by the transducer in the saddle is altered by the vibration of the rods. The altered signal is transmitted to the audio system for amplification and sound reproduction. It is preferred, however, that the rod vibration also be picked up separately and added to the transducer output signal. Combining the separate signals from the rod vibration and the saddle transducer has been found to maximize the sound quality produced by the instrument. For example, referring particularly to FIG. 3, in one embodiment, the resonator assembly 12 includes a piezoelectric transducer 66 mounted in each resonator rod 58 near its base to pick up the vibration of the rod and to convert the picked-up vibration to an electrical signal. The signal from the rod pick-up 66 is combined with the signal from the saddle transducer for transmission to an audio system, where they are amplified and reproduced into sound. The reproduction and amplification means are conventional components well known to those skilled in the art. Although the transducer of this embodiment is of the piezoelectric type, other types of transducers can be used, if desired.

Figure 5:
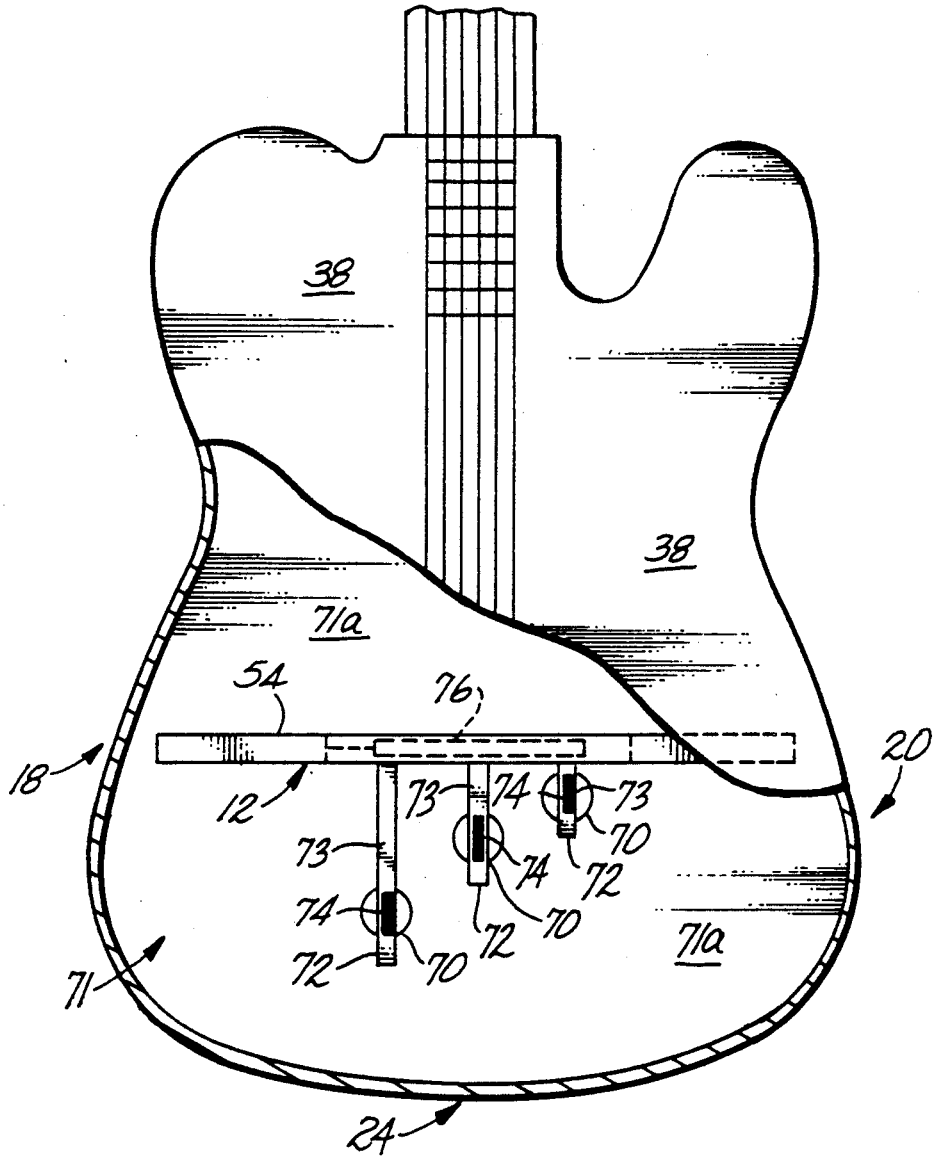
FIG. 5 is a semi-schematic cross-sectional view taken on line 5—5 of FIG. 1, showing another preferred embodiment of a resonator assembly provided in accordance with this invention mounted on the inside surface of the sound board with magnetic transducers mounted on the inside surface of the back of the instrument.

Turning to FIG. 5, there is shown a semi-schematic cross-sectional view, taken on line 5—5 of FIG. 1, showing another embodiment of a resonator assembly 12 provided in accordance with practice of this invention, which includes a rod vibration pick-up device different from the pick up 66 disclosed in the embodiment of FIGS. 1–4. In this embodiment, the resonator assembly 12 includes three magnetic pick-up devices 70 mounted on the interior surface 71*a* of the back 71 of the guitar 10. Each of the three pick-up devices 70 is in proximity to one of the free ends 72 of each resonator rod 73. Each such rod 73 includes a piece of magnetic material 74 embedded in its free end 72 adjacent the associated pick-up device 70 to transmit the vibration of the rod to the pick-up device for conversion into an electrical signal. In this embodiment, as was the case with the previous embodiment, means are provided to transmit the electrical signal to an audio system to be combined with the signal from the saddle transducer for amplification and reproduction into sound. In another embodiment, the magnetic pick-up device mounted on the interior surface 71*a* of the guitar back 71 is continuous and extends beneath the ends of all three rods instead of being provided as separate magnetic pads 70.

In yet another embodiment, also shown in FIG. 5, a piezoelectric pick-up device 76 is mounted on the bottom of the resonator rod support 54, and the magnetic pick ups 70 are not present. In this embodiment, the signal from the piezoelectric pick up 76 is combined with the signal from the saddle transducer.

Figure 6:
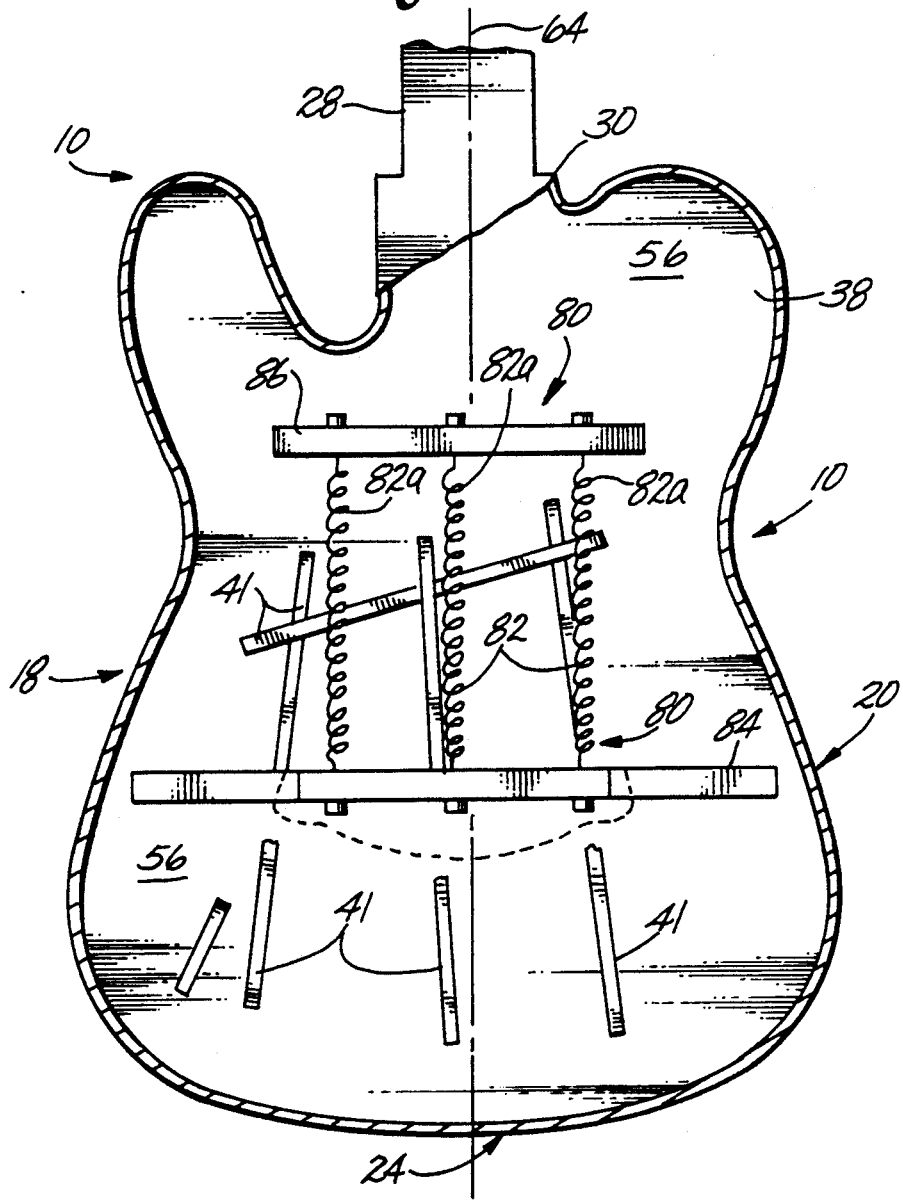
FIG. 6 is a semi-schematic cross-sectional view taken on line 6—6 of FIG. 1, showing yet another preferred embodiment of a resonator assembly provided in accordance with this invention mounted on the inside surface of the sound board.
Figure 7:
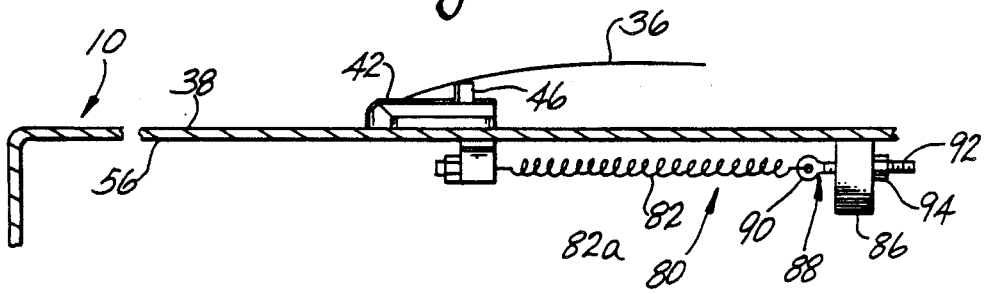
FIG. 7 is a semi-schematic, fragmentary cross-sectional view, taken on line 7—7 of FIG. 1, showing the resonator assembly of FIG. 6.

Turning to FIGS. 6 and 7, there are shown semi-schematic cross-sectional views, taken on lines 6—6 and 7—7 of FIG. 1, respectively, showing another preferred embodiment of a resonator assembly 80 provided in accordance with this invention. The resonator assembly 80 incorporates resonator springs 82 instead of rods, and can be used both for hollow- and solid-body stringed instruments.

The assembly 80 incorporates a pair of resonator supports 84 and 86, which are mounted on the interior surface 56 of the sound board 38, and which are spaced apart from each other along the longitudinal axis 64 of the instrument. Three resonator springs 82 are attached between the resonator supports 84 and 86 and extend generally parallel to each other and to the longitudinal axis 64 of the instrument. As was the case with the resonator rods incorporated in the resonator assemblies of the previous embodiments, more or fewer than three resonator springs 82 can be used, if desired. Means are provided to adjust the tension on the springs to thereby tune them to the desired frequencies. The preferred frequencies are the same as the preferred frequencies described above for the resonator rods of the previous embodiments. In the illustrated embodiment, the spring tension is adjusted by means of an eyebolt assembly 88 (shown best in FIG. 7), which includes a loop 90 and a threaded shank 92, which extends through a bore (not shown) formed in the support 86. A nut 94 is threaded onto the shank 92. The ends 82*a* of the springs opposite from the eyebolt assembly are attached by appropriate means to the support 84. When the nut 94 is tightened on the shank 92, the spring is stretched, thereby increasing its tension, resulting in an increase in its resonant frequency. When the nut 94 is loosened, the spring is relaxed, thereby decreasing its tension and, thus, decreasing its resonant frequency.

It is preferred that the support 86, which incorporates the tension adjusting means, i.e., the eyebolt assembly 88, be spaced apart from the bridge, and that the resonator support 84 be positioned on the surface of the sound board nearly under the bridge.

Figure 8:
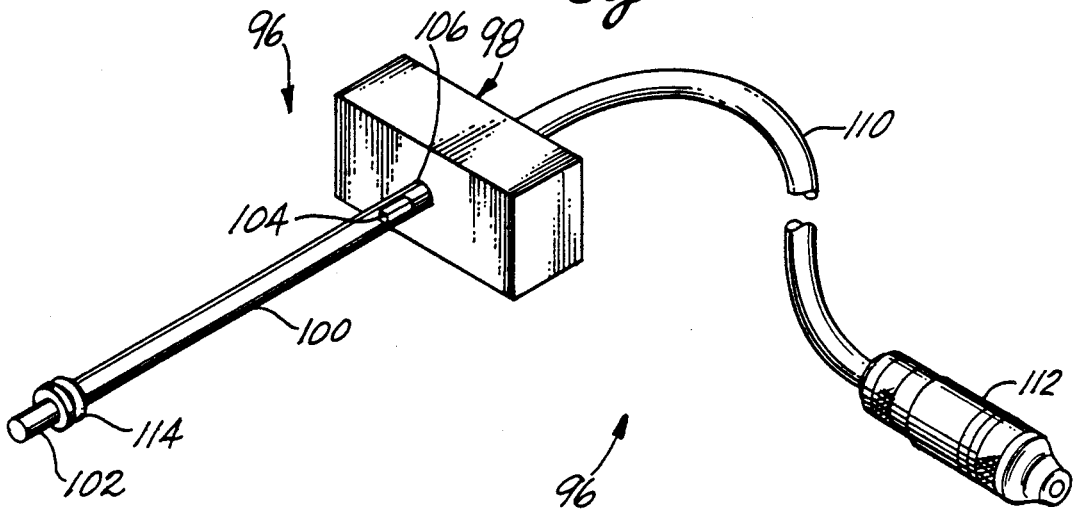
FIG. 8 is a semi-schematic perspective view of one embodiment of a resonator rod assembly kit provided in accordance with practice of this invention for installation on the inside surface of the sound board of a stringed instrument.

Turning to FIG. 8, there is shown a semi-schematic perspective view of a resonator rod assembly 96 provided in accordance with the present invention in kit form for installation on the inside or outside surface of a sound board of an already existing stringed instrument. For example, such a resonator assembly 96 could be installed by a musician on a guitar that he has been using to enhance the sound quality of the instrument. The resonator rod assembly 96 includes a support pedestal 98 in the shape of a rectangular block configured to be attached to the inside or outside surface of the sound board of a hollow-body guitar. At least one resonator rod 100 is mounted in the support pedestal with its free end 102 remote from the pedestal and configured to extend generally parallel to the sound board surface. In the illustrated embodiment, a transducer 104 is mounted in the rod 100 near its base 106 to pick up the vibration of the rod. Means, including a wire 110 and plug 112, are provided for transmitting the picked-up vibration to an audio system. Means are also provided for varying the resonant frequency of the rod. In the illustrated embodiment, the frequency-varying means is a slide in the form of an O-ring 114 mounted on each such rod 100 for sliding movement along its length. Preferably, each rod 100 is capable of being tuned to a frequency below about 200 cycles per second. More preferably, the rods 100 are capable of being tuned to less than about 130 cycles per second.

Although the resonator rod assembly kit of the illustrated embodiment incorporates a single rod 100, more than one such rod may be provided on a single support pedestal 98, or more than one rod assembly 96 may be provided in the kit. When a resonator rod assembly kit is provided with two rods 100 mounted on the same support pedestal 98, the rods preferably are capable of being tuned to the same frequency, or to a consonance. Furthermore, when three such rods are provided on a single pedestal, the rods preferably are capable of being tuned to the same frequency, to a consonance, or to a chord. If desired, the rods can be pretuned and the O-ring slide eliminated.

A primary purpose of the rod or rods 100 provided by the resonator assembly 96 is to add back to the signal from the saddle transducer that portion of the signal removed due to the resonance of the air column within the instrument's body that is out of phase with the sound board. By placing an amplified, tuned rod, such as the rod 100, tuned to the air resonance frequency of a typical full-body acoustic guitar, i.e., to about 130 cycles per second, that portion of the signal removed by the out-of-phase resonating air column is added back to the instrument's sound by the signal from the rod.

Figure 9:
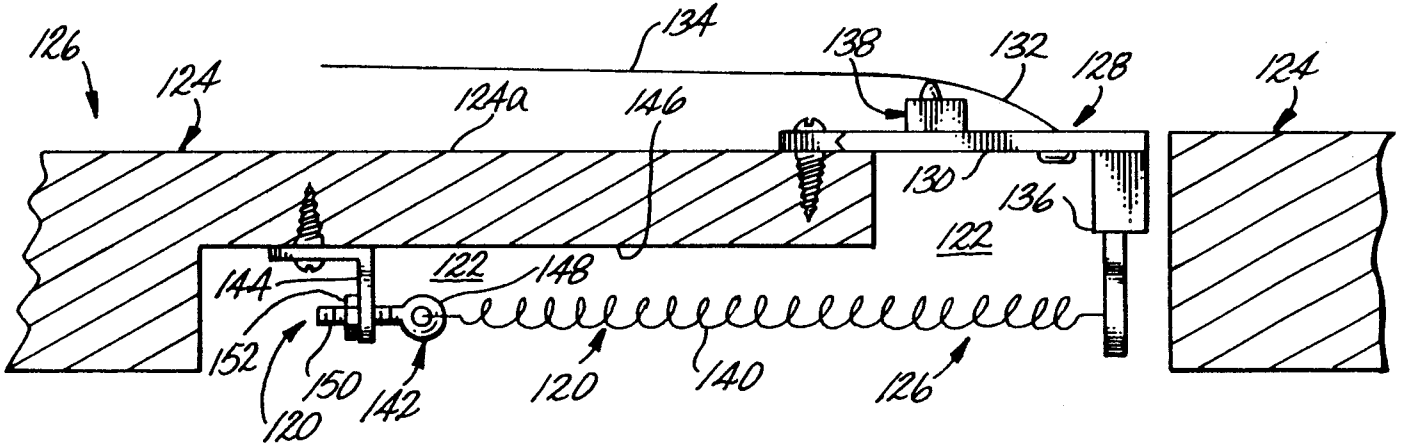
FIG. 9 is a semi-schematic fragmentary view, in partial cross-section, showing a preferred embodiment of a resonator assembly provided in accordance with practice of the present invention mounted in a cavity formed in a solid-body electric guitar.

Referring now to FIG. 9, there is shown a semi-schematic fragmentary view, in partial cross-section, of a preferred embodiment of a resonator assembly 120 provided in accordance with practice of the present invention mounted in a cavity 122 formed in the body 124 of a solid-body guitar 126. A bridge assembly 128, which is mounted on the exterior surface 124*a* of the body, includes a mounting section 130 onto which the proximal ends 132 of the strings 134 are attached and a resonator spring attachment section 136, which extends generally vertically downwardly into the cavity 122. A saddle assembly 138 is mounted on the bridge assembly 128. The strings 134 extend from their distal end attachments on the neck of the guitar (not shown), over the top surface of the saddle assembly 138, to their proximal end attachments 132 on the mounting section 130 of the bridge assembly 128.

The resonator assembly 120 comprises at least one resonator spring 140 mounted within the cavity 122. The springs 140 extend generally about parallel to the longitudinal axis of the instrument. In an exemplary embodiment, the springs 140 are attached by means of eyebolt assemblies 142, which, in turn, are mounted on an L-shaped bracket 144 attached to a horizontal surface 146 of the guitar body 124 in the cavity 122. As was the case with the embodiment discussed with reference to FIG. 7, each such eyebolt assembly includes a loop 148 and a threaded shank 150. The shank 150 extends through the downwardly extending flange of the L-shaped bracket and is secured by a nut 152. The tension and, hence, resonant frequency of the springs is adjusted by tightening or loosening the nut, as desired. Preferably, the resonator springs are tuned as is described above for tuning the springs associated with the embodiment of FIGS. 6 and 7.

Figure 10:
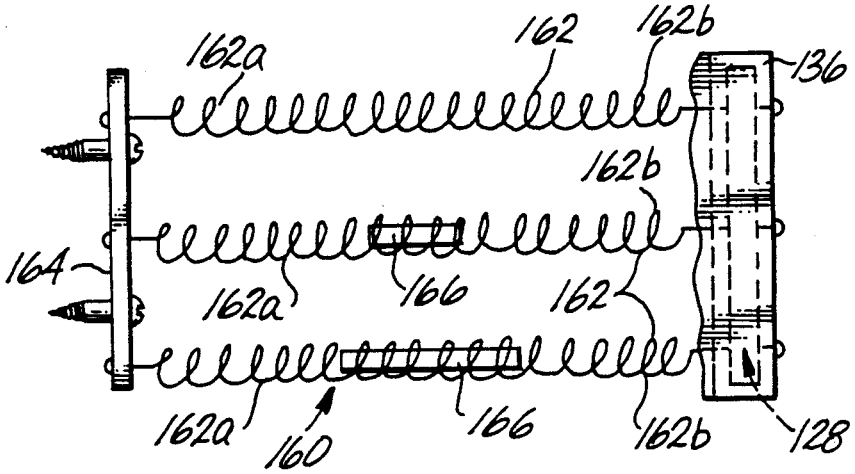

Turning to FIG. 10, there is shown a preferred embodiment of a resonator spring assembly kit 160 provided for installation within a cavity formed in the body of a solidbody electric guitar. The spring assembly 160 comprises at least three resonator springs 162 extending in side-by-side relationship between one end 162*a* attached to a resonator spring support 164, and its opposite end 162*b* configured to be attached to a bridge extension, such as the extension 136 of the bridge assembly 128 of FIG. 9 (shown in phantom lines in FIG. 10). Means are provided for tuning the resonator springs to a frequency below about 200 cycles per second and to provide a chord. In one embodiment, the tuning means include eyebolt arrangements (not shown), such as those described with regard to FIG. 7, which are provided in the spring support 164 and to which the ends 162*a* of the springs are attached. In another embodiment, the tuning means comprise cylindrical weights 166 having different masses which are incorporated into the coil of the spring, as desired, to alter the resonant frequency of the spring.

Although the resonator rod and spring assemblies of the present invention were described with reference to incorporation into hollow- and solid-body guitars, they are also useful for incorporation into other stringed instruments with or without associated elongated necks, such as mandolins, mandolas, harps, pianos and harpsichords.

The above descriptions of preferred embodiments of stringed instruments provided in accordance with this invention with incorporated resonator assemblies are for illustrative purposes. Because of variations, which will be apparent to those skilled in the art, the present invention is not intended to be limited to the particular embodiments described above. The scope of the invention is defined in the following claims.

What is claimed is:

1. A stringed instrument comprising a body portion and an elongated neck portion, the neck portion attached at one end to the body portion and extending away therefrom, the distal end of the neck adapted to attach the distal ends of a plurality of strings, the body portion comprising:

(a) a sound board having an interior surface and an exterior surface;

(b) a bridge assembly mounted on the exterior surface of the sound board, the bridge assembly comprising:

(i) a bridge onto which the proximal ends of the strings are attached;

(ii) a saddle assembly mounted on the bridge, the strings extending from their distal end attachments on the neck over the top surface of the saddle assembly to their proximal end attachments on the bridge; and (iii) a transducer mounted on the bridge provided to pick up the vibration of the strings, the transducer incorporating means for transmitting the picked-up signal to an audio system for amplification and reproduction into sound; and (c) a resonator assembly comprising:

(i) a resonator rod support mounted on the interior surface of the sound board; and (ii) at least one resonator rod having one end mounted on the rod support and a free end extending away from the rod support, with the longitudinal axis of such a resonator rod extending generally about parallel to the longitudinal axis of the instrument.

2. A stringed instrument as is claimed in claim 1 wherein the saddle assembly is positioned on the bridge between the center of the bridge and the distal edge of the bridge.

3. A stringed instrument as is claimed in claim 1 wherein the attachments of the proximal ends of the strings are between the center of the bridge and the proximal edge of the bridge.

4. A stringed instrument as is claimed in claim 2 wherein the resonator rod support is under at least a portion of the bridge.

5. A stringed instrument as is claimed in claim 1 wherein the resonator rod support is elongated and is at least about as long as the saddle.

6. A stringed instrument as is claimed in claim 5 wherein the resonator rod support extends under at least a portion of the bridge.

7. A stringed instrument as is claimed in claim 1 wherein at least one such resonator rod is tuned to a frequency below the resonant frequency of the sound board.

8. A stringed instrument as is claimed in claim 1 wherein the resonator rod assembly includes at least two resonator rods, and wherein each of such resonator rods is tuned to a frequency below the resonant frequency of the sound board, the rods being tuned to provide a consonance.

9. A stringed instrument as is claimed in claim 1 wherein the resonator assembly includes at least three resonator rods, and wherein each of such resonator rods is tuned to a frequency below the resonant frequency of the sound board, the rods being tuned to provide a chord.

10. A stringed instrument as is claimed in claim 1 additionally comprising at least one pick-up device in addition to the transducer, the pick-up device being mounted on the instrument in proximity to at least one such resonator rod to pick up the vibration from the rod and to convert the picked-up vibration to an electrical signal for transmission to an audio system for amplification and reproduction into sound.

11. A stringed instrument as is claimed in claim 10 wherein the vibration pick-up device is mounted on the resonator rod support.

12. A stringed instrument as is claimed in claim 10 wherein the vibration pick-up device is magnetic and wherein each rod includes a piece of magnetic material embedded therein.

13. A stringed instrument as is claimed in claim 10 wherein the vibration pick-up device is located on the instrument adjacent the free end of the rod.

14. A stringed instrument as is claimed in claim 1 wherein each such resonator rod extends about parallel to the longitudinal axis of the instrument in the same direction from the resonator rod support.

15. A stringed instrument as is claimed in claim 14 wherein each such resonator rod extends toward the bottom end of the instrument.

16. A stringed instrument as is claimed in claim 1 wherein the resonator assembly comprises a single resonator rod, wherein such a resonator rod is tuned to between about 100 and 200 cycles per second.

17. A stringed instrument as is claimed in claim 1 wherein the resonator rod is tuned to approximately 130 cycles per second.

18. A stringed instrument as is claimed in claim 1 wherein the saddle assembly comprises an elongated saddle positioned so that its longitudinal axis extends across the strings.

19. A stringed instrument as is claimed in claim 18 wherein the transducer is mounted in the elongated saddle extending along the length of the saddle.

20. A stringed instrument as is claimed in claim 19 wherein the resonator assembly comprises a plurality of rods, a first portion of the rods tuned to a chord, and at least one rod tuned to the major natural resonance of the sound board, the instrument additionally comprising a second transducer provided to pick up the signal from the first portion of the rods, a third transducer provided to pick up the signal of the rod tuned to the natural frequency of the sound board, and means for adding the signal from the rod tuned to the natural frequency of the sound board 180° out of phase from the signal from the first portion of the rods.

21. A stringed instrument as is claimed in claim 1 wherein the instrument is a guitar with a resonator assembly that includes a single resonator rod and wherein the bridge has a front surface facing the top end of the instrument, a back surface facing the bottom end of the instrument, and opposite side surfaces facing the sides of the instrument, wherein the resonator rod support is positioned no more than about two inches from the front surface toward the top end of the instrument, no more than about three inches from the front surface toward the bottom end of the instrument, and no more than about two inches from the side surfaces toward the respective sides.

22. A stringed instrument as is claimed in claim 1 additionally comprising at least one pick-up device mounted in each such resonator rod to pick up the vibration of the rod and to convert the picked-up vibration to an electrical signal for transmission to an audio system for amplification and reproduction into sound.

23. A stringed instrument as is claimed in claim 22 wherein the vibration pick-up device is an electromechanical transducer.

24. A stringed instrument comprising a body portion and an elongated neck portion, the neck portion attached at one end to the body portion and extending away therefrom, the distal end of the neck adapted to attach the distal ends of a plurality of strings, the body portion comprising:

(a) a sound board having an interior surface and an exterior surface;

(b) a bridge assembly mounted on the exterior surface of the sound board, the bridge assembly comprising:

(i) a bridge onto which the proximal ends of the strings are attached, the strings extending in spaced apart generally-parallel relationship to each other and generally parallel to the longitudinal axis of the instrument; and (ii) an elongated saddle mounted on the bridge, the elongated saddle positioned so that its longitudinal axis extends across the strings, the saddle including a transducer which extends along the length of the saddle, with the strings extending from their distal end attachments on the neck, over the top surface of the saddle to their proximal end attachments on the bridge, the transducer providing pick up of the vibration of the strings and including means for transmitting the picked up signal to an audio system; and (c) a resonator assembly comprising:

(i) an elongated resonator rod support mounted on the interior surface of the sound board, the longitudinal axis of the rod support extending generally transverse to the direction of the strings; and (ii) at least one elongated resonator rod mounted on the rod support, with the longitudinal axis of such a resonator rod extending generally about parallel to the longitudinal axis of the instrument.

25. A stringed instrument as is claimed in claim 24 wherein the saddle assembly is positioned on the bridge between the center of the bridge and the distal edge of the bridge.

26. A stringed instrument as is claimed in claim 24 wherein the attachments of the proximal ends of the strings are between the center of the bridge and the proximal edge of the bridge.

27. A stringed instrument as is claimed in claim 24 wherein the elongated resonator rod support extends under at least a portion of the bridge.

28. A stringed instrument as is claimed in claim 24 wherein the elongated resonator rod support is at least about as long as the elongated saddle.

29. A stringed instrument as is claimed in claim 28 wherein the elongated resonator rod support extends under at least a portion of the bridge.

30. A stringed instrument as is claimed in claim 24 wherein at least one such resonator rod is tuned to a frequency below the resonant frequency of the sound board.

31. A stringed instrument as is claimed in claim 24 wherein the resonator rod assembly includes at least two resonator rods, and wherein each of such resonator rods is tuned to a frequency below the resonant frequency of the sound board, the rods being tuned to a consonance.

32. A stringed instrument as is claimed in claim 24 wherein the resonator assembly includes at least three resonator rods, and wherein each of such resonator rods is tuned to a frequency below the resonant frequency of the sound board, the rods being tuned to provide a chord.

33. A stringed instrument as is claimed in claim 24 additionally comprising at least one pick-up device mounted on the instrument in proximity to at least one such resonator rod to pick up the vibration from the rod and to convert the picked-up vibration to an electrical signal for combining with the signal from the transducer.

34. A stringed instrument as is claimed in claim 33 wherein the rod pick-up device is mounted on the resonator rod support.

35. A stringed instrument as is claimed in claim 33 wherein the rod pick-up device is magnetic and wherein each such rod includes a piece of magnetic material embedded therein.

36. A stringed instrument as is claimed in claim 24 wherein each such resonator rod extends about parallel to the longitudinal axis of the instrument in the same direction from the resonator rod support.

37. A stringed instrument as is claimed in claim 36 wherein each such resonator rod extends toward the bottom end of the instrument.

38. A stringed instrument as is claimed in claim 24 additionally comprising at least one pick-up device mounted in each such resonator rod to pick up the vibration of the rod and to convert the picked-up vibration to an electrical signal for transmission to an audio system for amplification and reproduction into sound.

39. A stringed instrument as is claimed in claim 38 wherein the vibration pick-up device is an electromechanical transducer.

40. A stringed instrument comprising a body portion and an elongated neck portion, the neck portion attached at one end to the body portion and extending away therefrom, the distal end of the neck adapted to attach the distal ends of a plurality of strings, the body portion comprising:

(a) a sound board having an interior surface and an exterior surface;

(b) a bridge assembly mounted on the exterior surface of the sound board, the bridge assembly comprising:

(i) a bridge onto which the proximal ends of the strings are attached;

(ii) a saddle assembly mounted on the bridge, the strings extending from their distal end attachments on the neck over the top surface of the saddle assembly to their proximal end attachments on the bridge; and (iii) a transducer mounted on the bridge provided to pick up the vibration of the strings, the transducer incorporating means for transmitting the picked-up signal to an audio system for amplification and reproduction into sound; and (c) a resonator assembly comprising:

(i) a pair of resonator supports mounted on the interior surface of the sound board and spaced apart from each other along the longitudinal axis of the instrument; and (ii) at least one resonator spring attached between the resonator supports, such a spring extending generally about parallel to the longitudinal axis of the instrument and tuned to a frequency below the resonant frequency of the sound board.

41. A stringed instrument as is claimed in claim 40 wherein the saddle assembly is positioned on the bridge between the center of the bridge and the distal edge of the bridge.

42. A stringed instrument as is claimed in claim 40 wherein the attachments of the proximal ends of the strings are between the center of the bridge and the proximal edge of the bridge.

43. A stringed instrument as is claimed in claim 40 wherein there are two resonator springs tuned to provide a consonance.

44. A stringed instrument as is claimed in claim 40 wherein the saddle assembly comprises an elongated saddle positioned so that its longitudinal axis extends across the strings.

45. A stringed instrument as is claimed in claim 44 wherein the transducer is mounted in the elongated saddle extending along the length of the saddle.

46. A stringed instrument as is claimed in claim 40 wherein one of the resonator supports is mounted under the bridge assembly.

47. A stringed instrument as is claimed in claim 46 wherein each such resonator spring is attached to the resonator support that is mounted under the bridge.

48. A stringed instrument as is claimed in claim 40 wherein a first one of the resonator supports is mounted under the bridge assembly for attachment of each of the resonator springs, the instrument additionally comprising means associated with the second resonator support for changing the tension on the springs to thereby tune the springs to the desired frequencies.

49. A stringed instrument as is claimed in claim 40 wherein a single resonator support extends beneath the bridge for mounting each of the resonator springs, and a separate resonator support is provided to mount the opposite end of each such resonator spring.

50. A stringed instrument as is claimed in claim 40 wherein there are at least three resonator springs tuned to provide a chord.

51. A stringed instrument comprising a solidbody portion and an elongated neck portion, the neck portion attached at one end to the body portion and extending away therefrom, the distal end of the neck adapted to attach the distal ends of a plurality of strings, the body portion comprising:

(a) at least one cavity within the body;

(b) a bridge assembly mounted on the exterior surface of the body, the bridge assembly comprising:

(i) a bridge having a first portion onto which the proximal ends of the strings are attached and a second portion which extends into the cavity;

(ii) a saddle assembly mounted on the bridge, the strings extending from their distal end attachments on the neck over the top surface of the saddle assembly to their proximal end attachments on the first portion of the bridge; and (iii) a transducer mounted on the bridge provided to pick up the vibration of the strings, the transducer incorporating means for transmitting the picked-up signal to an audio system for amplification and reproduction into sound; and (c) a resonator assembly comprising at least three resonator springs mounted within the body cavity, the springs extending generally about parallel to the longitudinal axis of the instrument and tuned to provide a chord.

52. A stringed instrument as is claimed in claim 51 wherein the resonator springs are tuned to frequencies below 200 cycles per second.

53. A stringed instrument as is claimed in claim 51 wherein one end of each of the resonator springs is attached to the second portion of the bridge in the cavity.

54. A stringed instrument comprising a solid-body portion and an elongated neck portion, the neck portion attached at one end to the body portion and extending away therefrom, the distal end of the neck adapted to attach the distal ends of a plurality of strings, the body portion comprising:

(a) at least one cavity within the body;

(b) a bridge assembly mounted on the exterior surface of the body, the bridge assembly comprising:

(i) a bridge having a first portion onto which the proximal ends of the strings are attached and a second portion which extends into the cavity;

(ii) a saddle assembly mounted on the bridge, the strings extending from their distal end attachments on the neck over the top surface of the saddle assembly to their proximal end attachments on the first portion of the bridge; and (iii) a transducer mounted on the bridge provided to pick up the vibration of the strings, the transducer incorporating means for transmitting the picked-up signal to an audio system for amplification and reproduction into sound; and (c) a resonator assembly comprising at least two resonator springs mounted within the body cavity, the springs extending generally about parallel to the longitudinal axis of the instrument and tuned to provide a consonance.

55. A stringed instrument as is claimed in claim 54 wherein the resonator springs are tuned to frequencies below 200 cycles per second.

56. A stringed instrument as is claimed in claim 54 wherein one end of each of the resonator springs is attached to the second portion of the bridge in the cavity.

57. A resonator rod assembly for installation on the surface of a sound board of a stringed instrument, the resonator assembly comprising:

(a) a support pedestal configured to be attached to the surface of the sound board;

(b) at least one rod mounted in the support pedestal, such a rod having a free end remote from the pedestal and configured to extend generally parallel to the surface of the sound board;

(c) a transducer mounted in the rod to pick up the vibration of the rod; and (d) means for transmitting the picked-up vibration to an audio system.

58. A resonator rod assembly as is claimed in claim 57 wherein each such resonator rod is tuned to a frequency below 200 cycles per second.

59. A resonator rod assemblY as is claimed in claim 57 additionally comprising a slide mounted on each such rod for sliding movement along the length of the rod for varying the frequency to which the rod is tuned.

60. A resonator rod assembly as is claimed in claim 57 which comprises a single rod.

61. A resonator rod assembly as is claimed in claim 57 comprising at least two rods mounted on the support pedestal, wherein the rods are tuned to a consonance.

62. A resonator rod assembly as is claimed in claim 57 comprising at least three rods mounted on the support pedestal, wherein the rods are tuned to a chord.

63. A resonator rod assembly kit for installation on the surface of the sound board of a stringed instrument, the resonator assembly kit comprising:

(a) a support pedestal configured to be attached to the surface of the sound board;

(b) at least one rod mounted in the support pedestal, such a rod having a free end remote from the pedestal and configured to extend generally parallel to the surface of the sound board;

(c) a pick-up device for mounting on the instrument in proximity to each one of such resonator rods to pick up vibration from each such rod; and (d) means for transmitting the picked-up vibration from each such pick-up device to an audio system.

64. A resonator rod assembly as is claimed in claim 63 wherein each such resonator rod is tuned to a frequency below 200 cycles per second.

65. A resonator rod assembly as is claimed in claim 63 additionally comprising a slide mounted on each such rod for sliding movement along the length of the rod for varying the frequency to which the rod is tuned.

66. A resonator rod assembly as is claimed in claim 63 which comprises a single rod.

67. A resonator rod assembly as is claimed in claim 63 comprising at least two rods mounted on the support pedestal, wherein the rods are tuned to a consonance.

68. A resonator rod assembly as is claimed in claim 63 comprising at least three rods, wherein the rods are tuned to a chord.

* * * * *